US009120654B2

(12) United States Patent
Chaumontet

(10) Patent No.: US 9,120,654 B2
(45) Date of Patent: Sep. 1, 2015

(54) PULLEY WITH UNLOCKABLE CLAMP

(75) Inventor: Michael Chaumontet, Crolles (FR)

(73) Assignee: ZEDEL, Crolles (FR)

( * ) Notice: Subject to any disclaimer, the term of this patent is extended or adjusted under 35 U.S.C. 154(b) by 202 days.

(21) Appl. No.: 13/184,840

(22) Filed: Jul. 18, 2011

(65) Prior Publication Data

US 2012/0012800 A1 Jan. 19, 2012

(30) Foreign Application Priority Data

Jul. 16, 2010 (FR) ..... 10 03010

(51) Int. Cl.

| | |
|---|---|
| ***B66D 3/10*** | (2006.01) |
| ***B66D 3/04*** | (2006.01) |
| ***A62B 1/10*** | (2006.01) |
| ***B66D 5/16*** | (2006.01) |

(52) U.S. Cl.

CPC . *B66D 3/046* (2013.01); *A62B 1/10* (2013.01); *B66D 3/10* (2013.01); *B66D 5/16* (2013.01)

(58) Field of Classification Search

USPC ..... 254/391, 389, 390, 393, 394, 395, 396, 254/398, 401, 403, 408, 417, 375, 378

See application file for complete search history.

(56) References Cited

U.S. PATENT DOCUMENTS

| | | | | | |
|---|---|---|---|---|---|
| 210,281 | A | * | 11/1878 | Weston | 188/64 |
| 395,113 | A | * | 12/1888 | Batt | 254/391 |
| 473,093 | A | * | 4/1892 | Sockman | 254/391 |
| 916,091 | A | * | 3/1909 | Batzer | 188/64 |
| 1,107,934 | A | * | 8/1914 | Hagan | 188/65.1 |
| 1,304,353 | A | * | 5/1919 | Moss | 114/365 |
| 1,709,910 | A | * | 4/1929 | Gray | 114/210 |
| 2,723,834 | A | * | 11/1955 | Burke et al. | 254/402 |
| 2,800,300 | A | * | 7/1957 | Johnson et al. | 254/402 |
| 3,662,992 | A | * | 5/1972 | Vittert | 254/391 |
| 3,777,856 | A | * | 12/1973 | Gardner et al. | 188/65.1 |
| 5,056,760 | A | * | 10/1991 | Jorgensen | 254/406 |
| 5,348,117 | A | * | 9/1994 | Pickering | 182/5 |
| 5,664,640 | A | | 9/1997 | Smith | |
| 5,845,894 | A | | 12/1998 | Petzl et al. | |
| 6,182,946 | B1 | * | 2/2001 | Rutherford | 254/391 |
| 6,244,570 | B1 | * | 6/2001 | Habberstad | 254/406 |
| 7,445,195 | B1 | * | 11/2008 | Huang | 254/391 |
| 7,658,264 | B2 | * | 2/2010 | Mauthner | 182/5 |
| 7,845,467 | B2 | * | 12/2010 | Petzl et al. | 182/5 |
| 2007/0215411 | A1 | * | 9/2007 | Petzl et al. | 182/193 |

FOREIGN PATENT DOCUMENTS

| | | |
|---|---|---|
| EP | 0 803 268 A1 | 10/1997 |
| FR | 2 671 489 A1 | 7/1992 |
| JP | 54-042276 | 8/1954 |

OTHER PUBLICATIONS

Machine translation of FR 2671489 from espacenet.com performed Jun. 16, 2013.*

* cited by examiner

*Primary Examiner* — Emmanuel M Marcelo
*Assistant Examiner* — Justin Stefanon
(74) *Attorney, Agent, or Firm* — Oliff PLC

(57) ABSTRACT

A pulley with an unlockable clamp, comprising a rotary roller, a pivoting trigger designed to release and clamp the rope against the roller, and control means to keep the trigger in the inactive position disabling action of the clamp, wherein the control means comprise a lock fixed onto the first flange-plate and able to be actuated from a locked position to an unlocked position to enable movement of the trigger to the inactive position.

11 Claims, 5 Drawing Sheets

PULLEY WITH UNLOCKABLE CLAMP

BACKGROUND OF THE INVENTION

The invention relates to a pulley with an unlockable clamp, comprising a roller mounted rotating on a first flange-plate for guiding the rope, a trigger pivoting between an inactive position and an active position to respectively release and clamp the rope against the roller, and control means to keep the trigger in the inactive position disabling action of the clamp.

STATE OF THE ART

The document EP 803268 filed by the applicant describes a pulley with an integrated clamp of the kind mentioned. In the inactive position, use of the device is reduced to a conventional pulley without a clamp, on account of the fact that the trigger is locked and kept away from the rotating roller. In the active position, the trigger is free and is able to block the rope. The control means for keeping the pulley in the inactive position form part of the trigger following insertion of an additional karabiner in a locking opening provided in the trigger when the latter is in the separated position. The braking and jamming surface of the trigger then remains separated from the roller. The presence of this additional karabiner in addition to the attachment karabiner does however complicate the pulley handling operations.

OBJECT OF THE INVENTION

The object of the invention consists in providing a pulley with an integrated clamp having smaller dimensions and able to be handled easily.

The pulley with a clamp according to the invention is characterized in that the control means comprise a lock fixed onto the first flange-plate and able to be actuated from a locked position to an unlocked position to enable movement of the trigger to the inactive position.

Any attempt to perform forced movement of the trigger in the releasing direction is stopped in an intermediate position which is unstable as long as the lock remains in the locked position. Continued movement of the trigger to the stable inactive position is thereby prevented. Switching to this inactive position becomes possible again as soon as the user presses on the lock.

According to a preferred embodiment, the lock is pivoting around a spindle and is biased to the locked position by a bias spring. The lock comprises a notch in which a pin of the trigger engages to enable movement to the inactive position.

According to a feature of the invention, the lock is housed in a block fixed onto a first flange-plate, which also acts as support for the first spindle of the roller and for the second spindle of the trigger.

A movable second flange-plate is advantageously fitted swiveling on the end of the first spindle between a closed position and an open position. The first flange-plate comprises a first circular hole situated near the second spindle of the trigger and above the rotary roller. The second flange-plate is provided with a second circular hole coming into alignment in the closed position with the first hole of the first flange-plate enabling an attachment karabiner to be fitted therein.

BRIEF DESCRIPTION OF THE DRAWINGS

Other advantages and features will become more clearly apparent from the following description of an embodiment of the invention given for non-restrictive example purposes only and represented in the appended drawings, in which.

DETAILED DESCRIPTION OF THE INVENTION

Figure 1:
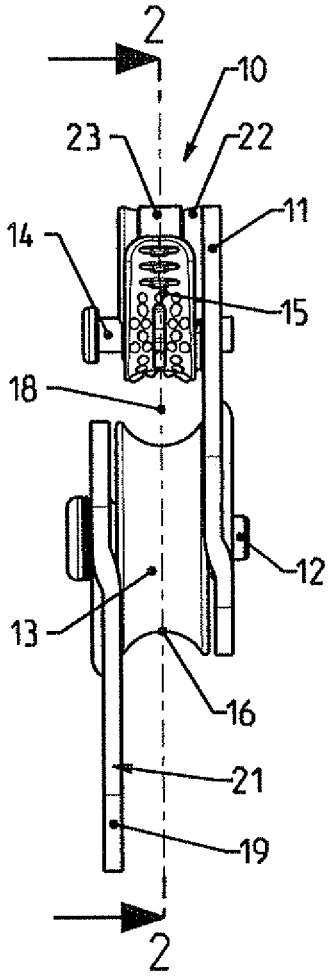
FIG. 1 is a side view of the pulley according to the invention, the second flange-plate being in the open position for fitting the rope on the rotary roller.

In the figures, a pulley 10 comprises a fixed first flange-plate 11 acting as support for a first spindle 12 of a rotary roller 13, and a second spindle 14 for pivoting of a blocking trigger 15.

The two spindles 12, 14 are fixed and extend parallel to one another in a perpendicular direction to first flange-plate 11. Cylindrical roller 13 is fitted rotating freely around first spindle 12, and is provided with an annular groove 16 at its periphery for guiding the rope.

Pivoting trigger 15 is provided with a braking surface 17 designed to press the rope against roller 13 to constitute a clamp integrated in the space 18 between the two spindles 12, 14. Braking surface 17 comprises a plurality of inclined spikes designed to enhance the clamping effect of the rope when the clamp is active. A spring (not shown) biases trigger 15 towards roller 13.

A movable second flange-plate 19 is mounted swiveling on one end of first spindle 12 between a closed position and an open position. The open position of second flange-plate 19 enables the rope to be fitted, after trigger 15 has been moved to the inactive position moving it away from roller 13. In the closed position of second flange-plate 19, the rope is wound in a loop on roller 13 and is held captive in the transverse gap arranged between the parallel flange-plates 11, 19.

First flange-plate 11 comprises a first circular hole 20 situated near second spindle 14 and above rotary roller 13. Second flange-plate 19 is provided with a second circular hole 21 which comes into alignment with first hole 20 when the two flange-plates 11, 19 are positioned in the closed position. An attachment karabiner can then be inserted therein to keep flange-plates 11, 19 in this position preventing any untimely swiveling.

A block 22 fixed to first flange-plate 11 is located above first hole 20 and occupies the transverse gap between flange-plates 11, 19. Block 22 is equipped with a lock 23 able to pivot around a spindle 24 between a locked position (FIGS. 2, 4 and 5) and an unlocked position (FIG. 3). Spindle 24 of lock 23 is parallel to second spindle 14 of trigger 15.

Figure 2:
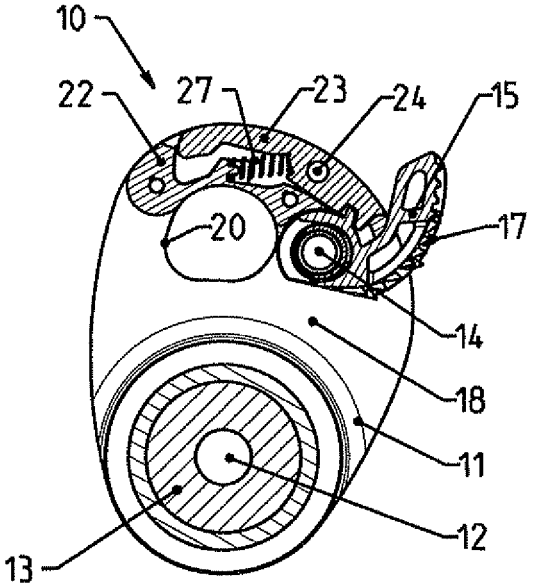
FIG. 2 is a vertical cross-sectional view along the line 2-2 of FIG. 1, the trigger being in the inactive position and the lock in the locked position.
Figure 3:
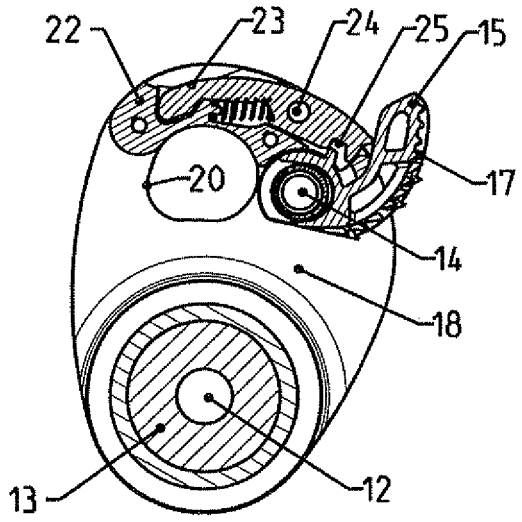
FIG. 3 shows an identical view to FIG. 2 when the lock is actuated to the unlocked position.

Lock 23 comprises a notch 25 in which a pin 26 of trigger 15 can engage to latch the latter in the inactive position of FIG. 2. A spring 27 biases lock 23 to the raised locked position. In this position, lock 23 is not salient from block 22.

Figure 8:
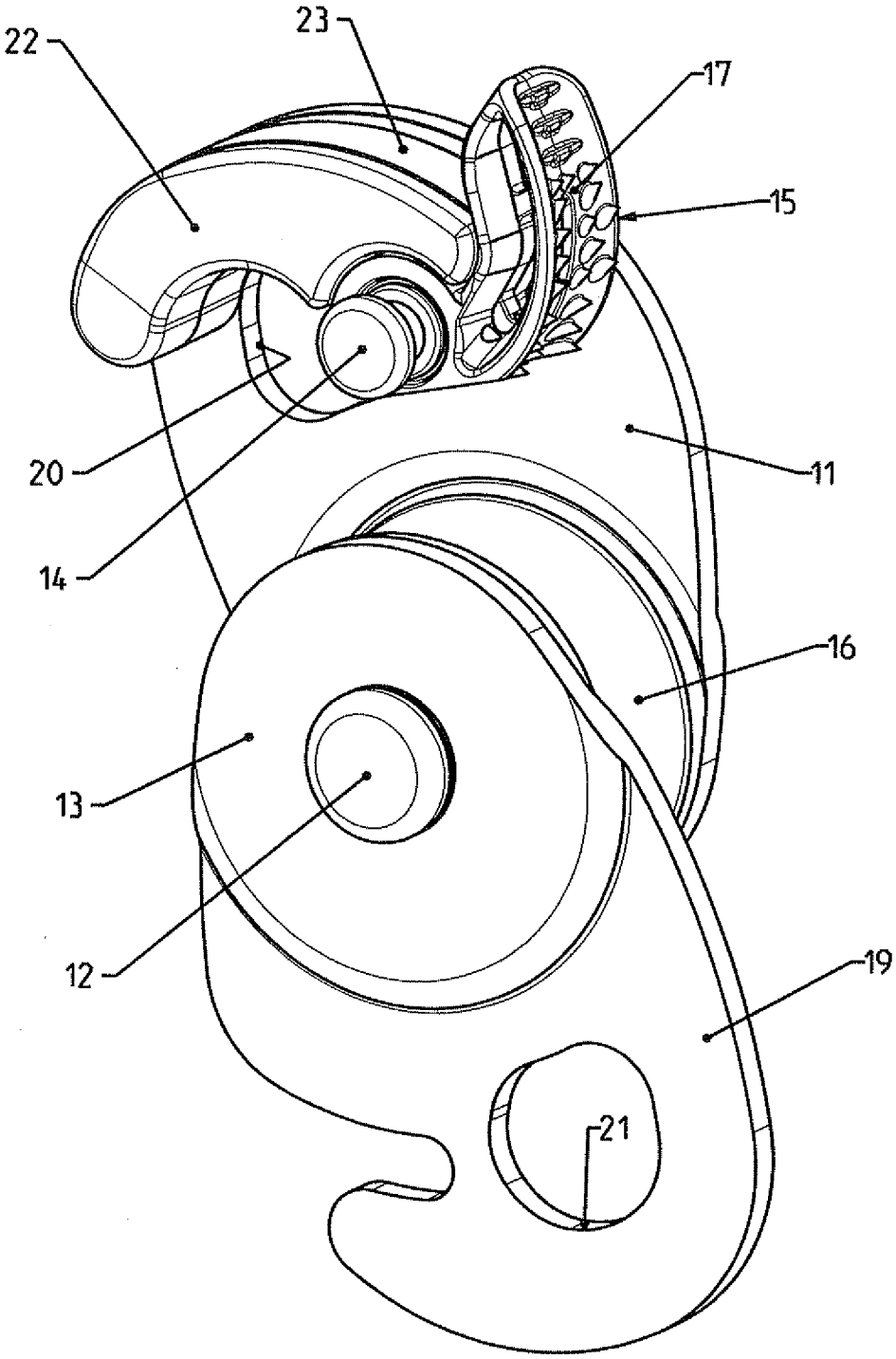
FIG. 8 is a perspective view of the pulley, the second swiveling flange-plate being in the open position and the trigger being in the inactive position away from the roller.

Operation of pulley 10 according to the invention is as follows:

With reference to FIGS. 1 and 8, second flange-plate 19 is swiveled to the open position to be able to fit the rope in groove 16 at the top part of rotary roller 13. Trigger 15 is kept in the inactive position, i.e. away from roller 13, against the opposing force of its bias spring.

FIG. 2 shows pulley 10 with trigger 15 being located in the locked inactive position. The clamp is not operational and roller 13 is free to rotate around first spindle 12. Pin 26 is housed in notch 25 of lock 23, which occupies the locked position. This position of trigger 15 is stable.

FIG. 3 represents releasing of trigger 15 after pressing on lock 23 which moves in block 22 to the unlocked position. Counterclockwise pivoting of lock 23 makes notch 25 withdraw enabling pin 26 to escape. Trigger 15 is located in the unlocked inactive position which is unstable.

Figure 4:
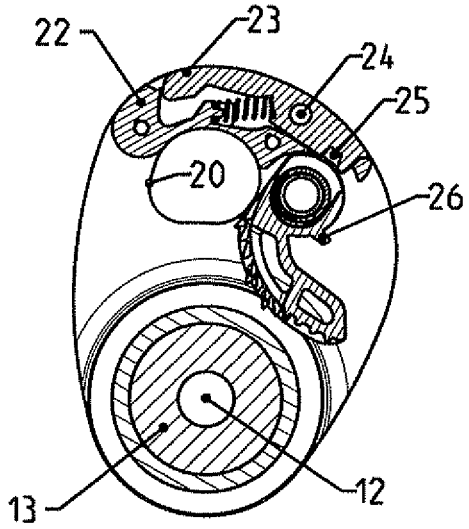
FIG. 4 represents an identical view to FIG. 3 when the trigger is free and ready to clamp the rope against the roller.

In FIG. 4, lock 23 returns to the locked position, after the bias spring has driven trigger 15 in the direction of roller 13. Trigger 15 is in the active position which is stable, The clamp can thus clamp the rope in case of tension occurring on the left-hand strand.

Figure 5:
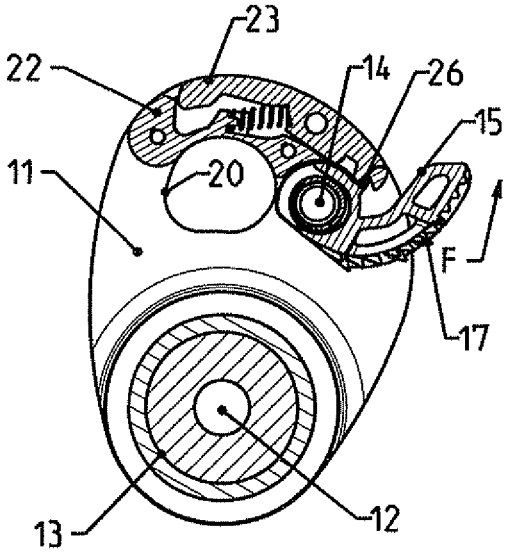
FIG. 5 is an identical view to FIG. 4 when a forced attempt is made to open the trigger, which is blocked in an intermediate position when the lock is locked.
Figure 6:
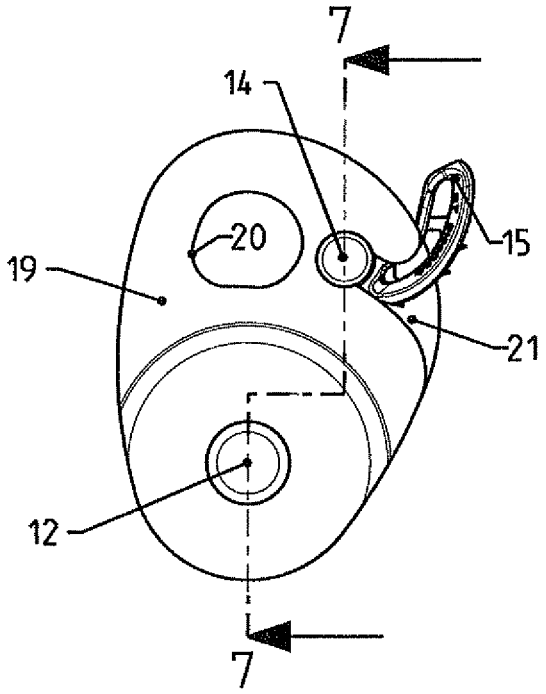
FIG. 6 illustrates an elevation of the pulley, the second swiveling flange-plate having been removed.
Figure 7:
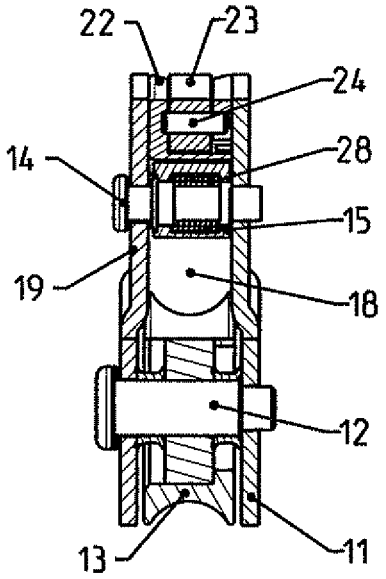
FIG. 7 is a cross-sectional view along the line 7-7 of FIG. 6.

In FIG. 5, lock 23 is still in the locked position and any forced movement of trigger 15 in the releasing direction (arrow F) is stopped in an intermediate position when pin 26 comes into engagement against a stop of lock 23. This position is unstable and lock 23 being kept in the locked position prevents any continued movement of trigger 15 to the stable position of FIG. 2. Movement to this position becomes possible again as soon as the user presses on lock 23.

I claim:

1. A pulley with an unlockable clamp, comprising:

a cylindrical roller rotatably mounted on a first flange-plate for guiding a rope;

a first spindle supported by the first flange-plate;

a trigger pivotable between an inactive position and an active position to respectively release and clamp the rope against the roller; and a control mechanism to keep the trigger in the inactive position disabling action of the clamp, and allowing said roller to rotate freely, wherein the control mechanism comprises a lock directly attached to the first flange-plate via a lock spindle such that the lock is pivotable around the lock spindle between a locked position and an unlocked position to enable movement of the trigger to the inactive position, and a movable second flange-plate is swivelably fitted on the end of the first spindle between a closed position and an open position.

2. The pulley with a clamp according to claim 1, wherein the lock is biased to the locked position by a bias spring.

3. The pulley with a clamp according to claim 2, wherein the lock comprises a notch in which a pin of the trigger engages to enable movement to the inactive position.

4. The pulley with a clamp according to claim 3, wherein the pin is a protrusion from a curved surface of the trigger.

5. The pulley with a clamp according to claim 3, wherein the lock includes an upper curved surface forming an external surface of the pulley.

6. The pulley with a clamp according to claim 5, wherein the notch is disposed on a surface opposite of the upper curved surface.

7. The pulley with a clamp according to claim 2, wherein the lock is housed in a block fixed onto the first flange-plate, which also acts as support for a second spindle on which the trigger is pivotably mounted, and the roller is rotatably mounted on the first spindle.

8. The pulley with a clamp according to ciaim 7, wherein the first flange-plate comprises a first circular hole situated near the second spindle and above the rotary roller, and the second flange-plate is provided with a second circular hole coming into alignment in the closed position with the first hole of the first flange-plate enabling an attachment karabiner to be fitted therein.

9. The pulley with a clamp according to claim 8, wherein the lock spindle is parallel to the second spindle.

10. The pulley with a clamp according to claim 7, wherein respective axes of the lock spindle, the first spindle, and the second spindle are parallel but are not coaxial.

11. The pulley with a clamp according to claim 1, wherein the lock includes an upper curved surface forming an external surface of the pulley.

* * * * *